United States Patent [19]

Dietiker et al.

[11] Patent Number: 4,547,144

[45] Date of Patent: Oct. 15, 1985

[54] FUEL GAS CONTROL

[75] Inventors: Paul Dietiker, Redondo Beach, Calif.; Elwyn H. Olson, St. Paul; Ralph H. Torborg, Minnetonka, both of Minn.

[73] Assignee: Honeywell Inc., Minneapolis, Minn.

[21] Appl. No.: 511,825

[22] Filed: Jul. 8, 1983

[51] Int. Cl.[4] ..... F23N 3/00

[52] U.S. Cl. ..... 431/20; 431/12; 236/15 BD; 236/15 C

[58] Field of Search ..... 431/12, 20, 19; 236/1 A, 15 C, 15 BD, 14; 137/489, 489.5, 495

[56] References Cited

U.S. PATENT DOCUMENTS

| | | | |
|---|---|---|---|
| 1,721,800 | 7/1929 | Wünsch . | |
| 1,914,949 | 6/1933 | Hardgrove | 158/28 |
| 2,026,197 | 12/1935 | Stoker | 236/14 |
| 2,030,386 | 2/1936 | Miller | 236/14 |
| 2,127,445 | 8/1938 | Hardgrove . | |
| 2,228,769 | 1/1941 | Klinker | 236/8 |
| 2,269,705 | 1/1942 | Besler . | |
| 2,723,558 | 11/1955 | Germer . | |
| 3,158,320 | 11/1964 | Duncan | 236/15 |
| 3,354,901 | 11/1967 | Dietiker et al. | 137/495 |
| 3,800,823 | 4/1974 | Visos et al. | 137/489.5 |
| 3,917,219 | 11/1975 | Hendrick | 251/45 |
| 3,964,675 | 6/1976 | Echner | 236/15 C |
| 4,251,025 | 2/1981 | Bonne et al. | 236/14 |
| 4,254,796 | 3/1981 | Kelly | 137/489 |
| 4,334,855 | 6/1982 | Nelson | 431/20 |
| 4,340,355 | 7/1982 | Nelson et al. | 431/20 |
| 4,460,329 | 7/1984 | Trent | 431/20 |
| 4,468,192 | 8/1984 | Jaeger | 431/20 |
| 4,483,672 | 11/1984 | Wallace et al. | 431/20 |

FOREIGN PATENT DOCUMENTS

| | | |
|---|---|---|
| 447840 | 4/1948 | Canada . |
| 25622 | 3/1981 | European Pat. Off. . |
| 0039579 | 4/1981 | European Pat. Off. . |
| 2006658 | 3/1970 | Fed. Rep. of Germany . |
| 2247559 | 4/1974 | Fed. Rep. of Germany . |
| 1310619 | 10/1961 | France . |
| 1481589 | 10/1975 | United Kingdom . |
| 1495799 | 10/1975 | United Kingdom . |
| 1578664 | 7/1977 | United Kingdom . |

OTHER PUBLICATIONS

T. deViaris, "Les Chaudières Individuelles à Condensation" Feb. 1983, (translation provided).

*Primary Examiner*—Margaret A. Focarino
*Attorney, Agent, or Firm*—John P. Sumner

[57] ABSTRACT

Disclosed is a fuel gas control for controlling the delivery of fuel gas. The present gas control comprises an inlet chamber having an inlet for receiving a supply of gas and an outlet chamber having an outlet for providing a supply of gas. The inlet and outlet chambers are connected by a valve opening. A valve is operatively associated with the opening. The valve has a closed position for preventing the flow of gas through the opening and an open position for permitting the flow of gas through the opening. The present control further comprises control chamber means for moving the valve between its open and closed positions in response to pressure variations within the control chamber means. The present control further comprises apparatus for directly connecting the control chamber means to a pressure signal from a power combustion air blower so that the valve is positioned in response to the pressure signal from the combustion air blower.

21 Claims, 7 Drawing Figures

FUEL GAS CONTROL

BACKGROUND OF THE INVENTION

In heating systems comprising a combustion air blower and a fuel valve for providing fuel to a burner, it is generally desired to provide fuel to the burner only when proper conditions exist for flame and to maintain an optimum fuel-to-air ratio when the burner is in operation. Prior art approaches to these problems are relatively complex. Accordingly, the present fuel gas controls were developed.

Systems incorporating the present invention are typically simplified over prior art systems and may incorporate one or more of three separate and distinct features: (1) the present invention may be incorporated to allow fuel to flow only upon sensing a predetermined minimum air flow; (2) the present invention may be incorporated to modulate the fuel flow so that a fixed fuel-to-air ratio is maintained; and (3) the present invention may be incorporated to shut off fuel completely if air flow substantially ceases, such as in the case of a blocked stack or malfunctioning combustion blower. While some or all of these features are available in prior art systems, these prior art systems are far more complex than systems incorporating the present invention.

Examples of systems over which the present invention provides simplification include those disclosed in U.S. Pat. No. 4,251,025. In those systems, for example, a separate pressure switch is required to check for a blocked stack, and this pressure switch is incorporated with a specialized control system which shuts off the fuel flow if pressure conditions are not correct. Through the present invention, no pressure switch or specialized control system for shutting off the valve is required.

The fuel gas control disclosed in U.S. Pat. No. 4,251,025 is typical of the relatively complex prior art controls which incorporate some or all of the three features listed above. Such prior art controls require a regulator valve section which comprises a regulating chamber as well as a seesaw-like operator valve actuated by a suitable electro-magnetic actuator (see, for example, U.S. Pat. No. 4,251,025, column 7, lines 4–7). Through the present invention, substantially simplified controls may be used; for example, no separate regulating chamber and no electro-magnetic actuator is required within the fuel gas controls disclosed in the present application.

SUMMARY OF THE INVENTION

The present invention is a fuel gas control for controlling the delivery of fuel gas. The present gas control comprises an inlet chamber having an inlet for receiving a supply of gas and an outlet chamber having an outlet for providing a supply of gas. The inlet and outlet chambers are connected by a valve opening. A valve is operatively associated with the opening. The valve has a closed position for preventing the flow of gas through the opening and an open position for permitting the flow of gas through the opening. The present control further comprises control chamber means for moving the valve between its open and closed positions in response to pressure variations within the control chamber means. The present control further comprises apparatus for directly connecting the control chamber means to a pressure signal from a power combustion air blower so that the valve is positioned in response to the pressure signal from the combustion air blower.

DESCRIPTION OF THE PREFERRED EMBODIMENTS

U.S. Pat. No. 4,251,025 provides a very complete description of how a furnace control system functions generally. That patent is incorporated by reference in the present application as if fully set forth herein.

Figure 1:
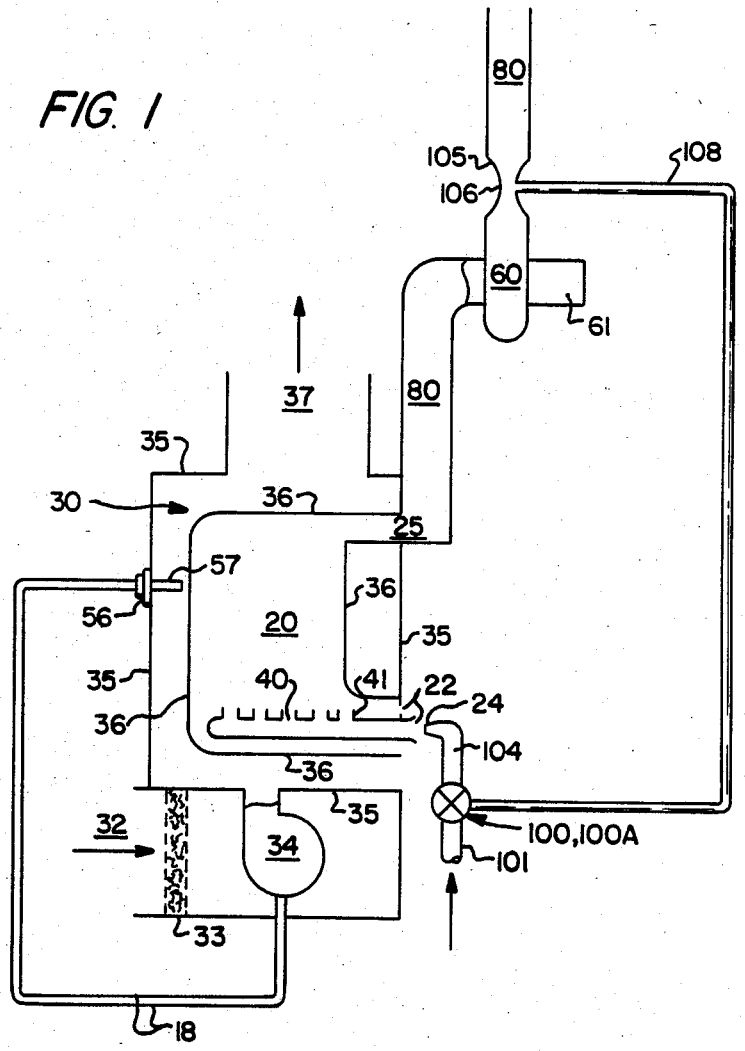
FIGS. 1 and 5 schematically illustrate heating systems incorporating the present invention.

FIG. 1 illustrates an induced draft furnace incorporating a fuel control in accordance with two alternate embodiments (100 and 100A, FIGS. 2 and 3) of the present invention. Although the present invention is not limited to induced draft furnaces, it will be explained here in connection with such a heating system. Other applications of the present invention include forced draft systems and power burners.

After operation of the FIG. 1 furnace system is explained, fuel controls 100 and 100A will be explained. An alternate fuel control (100B, FIG. 6) compatible with the furnace system illustrated in FIG. 5 will then be explained.

FIG. 1 Furnace System

The heating system shown in FIG. 1 comprises a combustion chamber 20 which has a burner 40 located near its bottom and which is substantially enclosed by exterior walls 36. Fuel, which in the preferred embodiment is a gas such as natural gas or liquified petroleum, is fed to burner 40 by a gas outlet 24 near the mouth of burner 40. Air enters burner 40 and combustion chamber 20 at air inlets 22 located near the tip of gas outlet 24 and the mouth of burner 40. Burner 40 is ignited by a pilot, not shown. Alternately, the system could include a direct ignition system (i.e., sparking the main burner directly) or an intermittent pilot.

Surrounding combustion chamber 20 is a heat exchanger 30 with its interior boundary being formed by exterior walls 36 of combustion chamber 20, the exterior boundary of heat exchanger 30 being formed by walls 35. Thus, two separate fluid paths are formed. The combustion chamber path leads from gas outlet 24 and air inlets 22 through burner 40 and out of a flue 25. The heat exchanger path follows the exterior walls 36 of combustion chamber 20; the fluid to be heated enters below burner 40 and proceeds along a vertical portion of the enclosed area between walls 35 and the exterior burner wall 36 to exit above combustion chamber 20. While in the embodiment shown air is the fluid to be heated, other fluids such as water may be used with minor design changes.

Movement of air into and through heat exchanger 30 is provided by a fan 34 driven by an electric motor. Cold air is pulled into heat exchanger 30 at a cold air return duct 32 and passes through an air filter 33 before it enters fan 34. Fan 34 drives the air into heat exchanger 30 through an opening in its bottom wall. Heated air passes out of heat exchanger 30 through a warm air duct 37 which extends from an opening in a top wall in heat exchanger 30.

With the exception of flue 25 and combustion air inlets 22, combustion chamber 20 is enclosed and substantially air tight. Accordingly, the only exit for combustion material is provided by flue 25. In order to induce air to enter combustion chamber at bottom air inlets 22 and to induce combusted gases to exit from combustion chamber 20 and flow out of flue 25 in exhaust stack or vent 80, an induced draft blower 60 is used. This induced draft blower (which is powered by an electric motor 61) is located in line with flue 25 and exhaust stack or vent 80. Blower 60 may be single or multiple speed, depending upon the type of control system with which it is to be used.

A fluid, preferably natural gas or liquified petroleum, is provided to burner 40 at gas outlet 24 which is fed by an outlet pipe 104 of a modulating fuel valve such as valve 100. Gas from a supply line at line pressure enters gas valve 100 at a gas inlet pipe 101. Gas regulated to the desired output pressure flows out of gas valve 100 through outlet pipe 104. The detailed structure and operation of gas valve 100 is described later in this application. Although gas valve 100 is the preferred valve embodiment, an alternate embodiment to gas valve 100 will also be described.

By way of further describing operation of the heating system illustrated in FIG. 1, fan 34 is electrically connected via wires 18 to a fan limit control switch 56 which is driven by a temperature sensitive element 57 such as a bimetal thermostat. This temperature sensitive element 57 causes fan 34 to be switched on when the air temperature in heat exchanger 30 rises above a predetermined temperature (fan start set point) and to be switched off when the temperature of the air in heat exchanger 30 falls below a predetermined temperature (fan stop set point). To minimize condensation in heat exchanger 30; the fan start set point is chosen substantially at or somewhat above the dew point. One suitable temperature sensitive switch for this purpose is the L4064 fan and limit switch manufactured by Honeywell Inc. of Minneapolis, Minn.

Because one purpose of fan limit control switch 56 is to delay fan start up until heat exchanger 30 contains air at or above the dew point, a time delay mechanism may be substituted for temperature sensitive element 57. This mechanism may be activated at the same time as blower motor 61, but it would delay fan start up for a predetermined period sufficient to let heat exchanger 30 reach the dew point temperature.

Gas inlet pipe 101 may comprise a manually-actuated on-off valve (not shown) between inlet 101 and the supply of fuel. Such a manually-actuated valve may be used to manually activate or deactivate the fuel controls disclosed in the present application. In such a case, opening of the manually actuated valve would be a prerequisite to any flow of gas from outlet pipe 104. Other "redundant" closure points may also be employed in order to provide additional conditions which must be met before valve 100 permits gas to flow to burner 40. However, such manually-actuated valves or other redundant closure points are not necessary to the present invention.

Fuel controls 100 and 100A discussed below operate in connection with venturi nozzle 106 on one side of combustion blower 60. An aperture in venturi nozzle 106 is connected directly to pressure chambers 118 and 118A in valves 100 and 100A, respectively by a pressure conduit 108. The preferred location for venturi nozzle 106 is in exhaust stack 80 downstream of combustion air blower 60. However, venturi nozzle 106 may be located on either side of combustion air blower 60 in any suitable portion of the air flow. Note also that, while venturi 105 is shown occupying the entire cross-sectional area of exhaust stack 80, a smaller venturi, not occupying the entire cross-sectional area of exhaust stack 80 or other housing, would also be compatible with the present invention.

Fuel controls 100 and 100A are actuated (turned on) and deactiviated (turned off) by pressure signals received directly from venturi nozzle 106. In addition, as will be further explained below, fuel control 100 is constructed so that its output is modulated based on the pressure communicated to control chamber 118 through conduit 108 from nozzle 106. Similarly, as will also be explained below, fuel control 100B provides a modulated output based on the pressure communicated to control chamber 118B from the region upstream of orifice plate 107. Accordingly, with fuel controls 100A and 100B, the firing rate of the furnace or other appliance will be determined by the combustion air flow rate, which is determined primarily by the speed of combustion blower 60. Thus, proof of combustion air as well as blocked stack detection is inherent in systems incorporating these controls.

For example, in the case of fuel controls 100 and 100A operating in connection with venturi nozzle 106 as illustrated in FIG. 1, a totally blocked stack will result in positive pressure from venturi nozzle 106 being communicated through conduit 108 to valve 100 or 100A which will then turn off gas flow to outlet 104. A partially blocked stack will decrease the flow through venturi nozzle 106 resulting in a lower feedback signal through pressure conduit 108 and, in the case of fuel control 100, less gas flow through valve 100. Accordingly, appropriate clean combustion will be maintained.

Fuel Controls 100 and 100A

These features are now available for the first time in a system through the present invention which is inherently safe and which requires no flow or pressure sensor to prove combustion air or to detect blocked stacks. Further, the presently disclosed valves are much simpler than valves previously available in the prior art.

Figure 2:
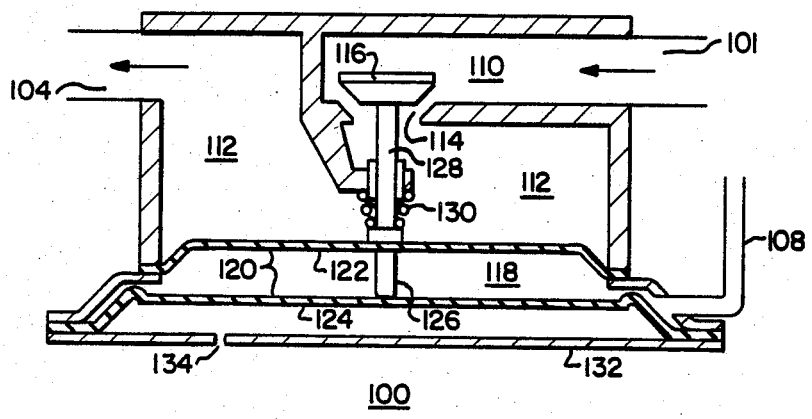
FIGS. 2, 3 and 6 illustrate alternate embodiments of the present invention.

FIG. 2 illustrates fuel control 100, which is an alternate preferred embodiment of the present invention. Fuel control 100 comprises an inlet chamber 110 having an inlet 101 for receiving a supply of gas. The control also comprises an outlet chamber 112 having an outlet 104 for providing a supply of gas. The inlet and outlet chambers are connected by valve opening 114. Fuel control 100 also comprises a valve 116 operatively associated with opening 114, valve 116 having a closed position for preventing the flow of gas through opening 114 and an open position for permitting the flow of gas through the opening.

As illustrated in FIG. 2, fuel control 100 also comprises a control chamber 118 bounded in part by diaphragm means 120 mechanically coupled to valve 116 for moving the valve in response to movement of diaphragm means 120. In the embodiment shown, diaphragm means 120 comprises a first diaphragm 122 and a second diaphragm 124, the two diaphragms being shown mechanically coupled by a pin 126 located approximately central to the diaphragms. Diaphragm 122, which also partially encloses outlet chamber 112, is mechanically coupled to valve 116 and to pin 126 by a pin 128. In the FIG. 2 embodiment of fuel control 100, an optional bias means or spring 130 is illustrated for keeping valve 116 in its closed position whenever the pressure in control chamber 118 is above a predetermined negative pressure level and for permitting valve 116 to move to its open position(s) whenever the pressure in control chamber 118 is below the predetermined negative pressure level (as an alternate example to bias spring 130, diaphragm means 120 could employ a configuration which inherently provides the bias provided by spring 130). Pressure conduit 108 provides means for directly connecting control chamber 118 to venturi nozzle 106 so that valve 116 moves in response to the pressure signal from venturi nozzle 106.

In the embodiment illustrated in FIG. 2, control chamber 118 is bounded by an upper diaphragm 122 which is smaller than a lower diaphragm 124. As previously indicated, these two diaphragms form diaphragm means 120 mechanically coupled to valve 116 for moving valve 116 in response to movement of diaphragms 122 and 124. For the FIG. 2 embodiment, a negative pressure below a predetermined level introduced into control chamber 118 through pressure conduit 108 from venturi nozzle 106 causes valve 116 to move in an upward direction, thus permitting the flow of gas through orifice 114 from inlet chamber 110 to outlet chamber 112. If the negative pressure in chamber 118 is or goes above the predetermined negative pressure, valve 116 will remain or will go closed.

In the embodiment shown, lower diaphragm 124 is protected by housing 132 comprising air leak orifice 134 for permitting valve means 120 to freely move in response to the pressure changes within chamber means 118.

Figure 4:
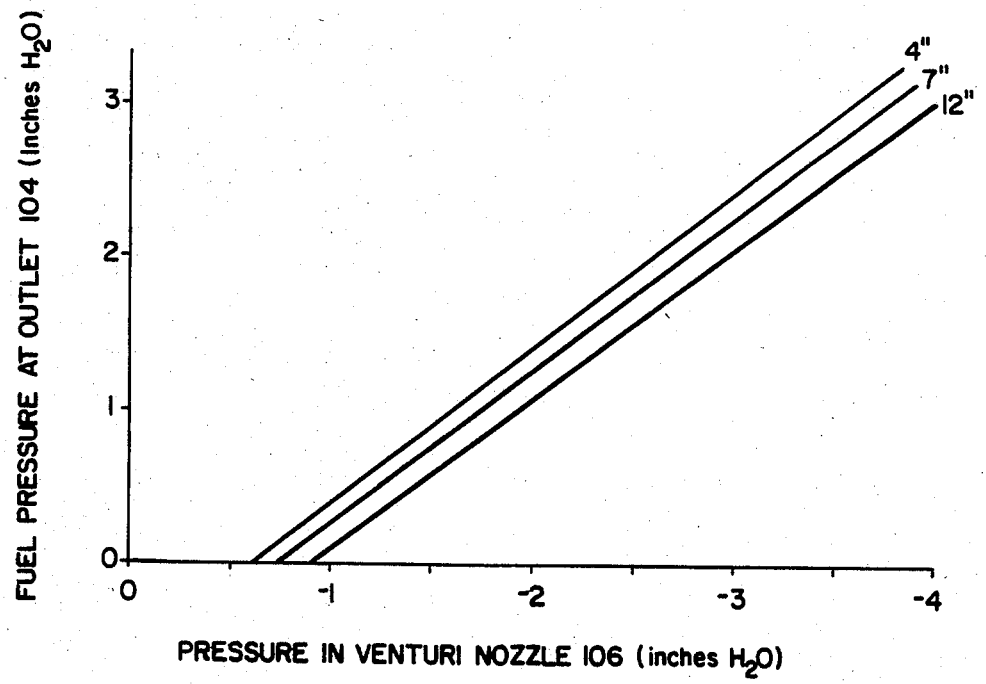
FIGS. 4 and 7 illustrate typical performance of the embodiments shown in FIGS. 2 and 6, respectively.

Although fuel control 100 may be configured as merely an on-off valve (so that the fuel control does not modulate the output gas pressure) the preferred embodiment of the present control modulates the pressure available at outlet 104 as a function of the negative pressure in venturi nozzle 106. FIG. 4 is a typical plot of the output pressure at outlet 104 versus the negative pressure in venturi nozzle 106 for a valve of the embodiment shown in FIG. 2. Note that, as the negative pressure in venturi nozzle 106 (and, accordingly, in control chamber 118) goes below a predetermined negative pressure, the fuel pressure at outlet 104 increases.

The FIG. 2 embodiment provides this modulation by the combined effect of the outlet gas pressure acting against one side of diaphragm 122 and the effect of the pressure in control chamber 118 acting on the other side of diaphragm 122 as well as exerting an upward force on diaphragm 124. As negative pressure in chamber 118 decrease (i.e., as the absolute value of this pressure increases), the forces on diaphragms 122 and 124 tend to open valve 116 (i.e., to push it upward), resulting in increased pressure in outlet chamber 112 and at outlet 104; the resulting increased outlet pressure in chamber 112 results in a downward force on diaphragm 122, tending to close valve 116 (i.e., to push it downward).

The equilibrium position of valve 116 and, accordingly, the pressure at outlet 104 is determined by this system balance, which changes as the pressure in chamber 118 changes. Thus, as can be seen from FIG. 4, the gas pressures provided at outlet 104 vary in relation to the pressure in venturi nozzle 106 and, accordingly, in relation to the pressures within control chamber 118. As a secondary effect, the input gas pressure at inlet 101 and in inlet chamber 110 affects this equilibrium position as an offset; see, for example, the three plots in FIG. 4 which represent typical data for input pressures at inlet 101 of 4, 7 and 12 inches of water respectively.

Figure 3:
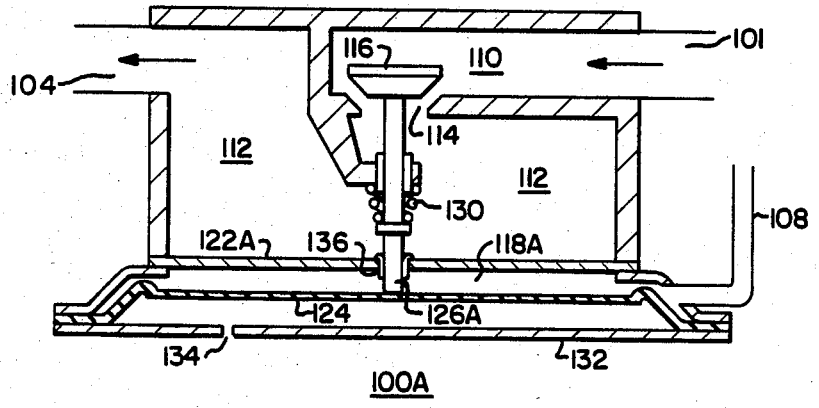

Although FIG. 2 illustrates the preferred embodiment of fuel control 100, other embodiments within the scope of the present invention are also possible. For example, as illustrated in FIG. 3, diaphragm 122 could be replaced with a non-flexible member 122A having a pin 126A moveably passing through the member; pin 126A is connected to valve 116 and to diaphragm 124 and is sealed with a pressure seal 136 at the point it passes through member 122A. Valve 116 moves in response to movement of diaphragm 124 which in turn moves pin 126A up and down through sealed hole 136 in member 124A. As with the embodiment shown in FIG. 2, diaphragm 124 in the FIG. 3 embodiment moves in response to the negative pressure in the control chamber above it; i.e., in response to the negative pressure in chamber 118A, the pressure in chamber 118A being communicated to the chamber through pressure conduit 108 from venturi nozzle 106.

Fuel Control 100B

An alternate fuel control 100B illustrated in FIG. 6 and compatible with the furnace system illustrated in FIG. 5 will now be explained.

Figure 5:
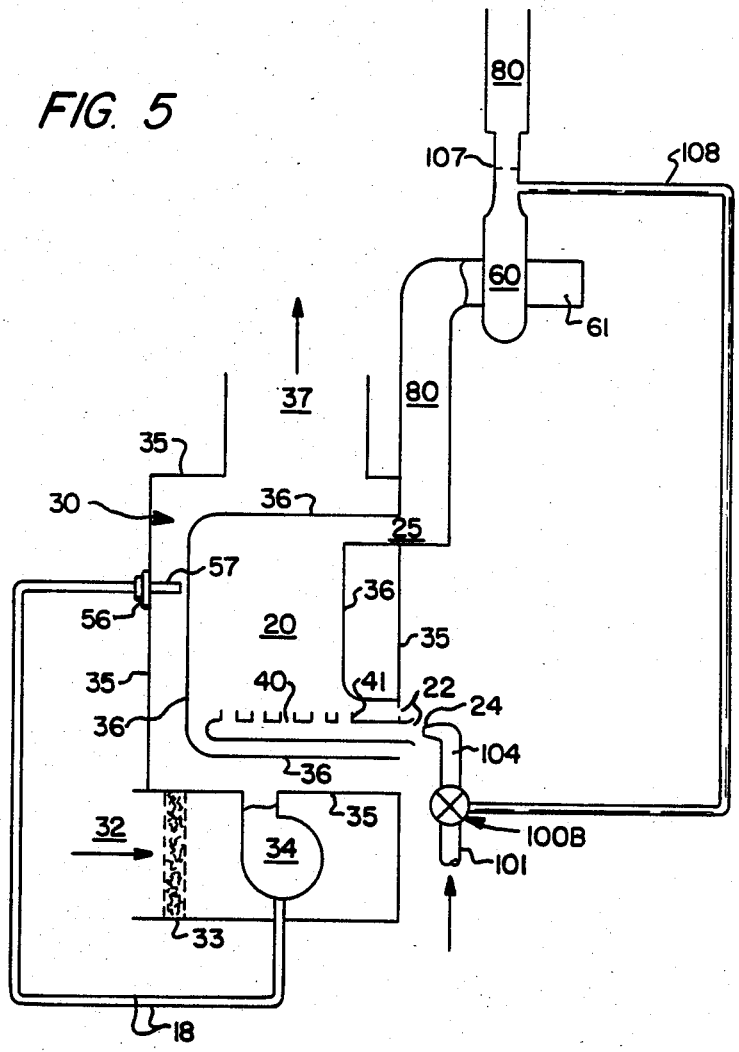

The furnace system of FIG. 5 is identical to that of FIG. 1 except that stack 80 comprises an orifice plate 107 rather than a venturi 105 and venturi nozzle 106. Orifice plate 107 comprises an orifice which causes a positive pressure build up upstream of orifice plate 107 during proper operating conditions of the furnace. Pressure conduit 108 connects directly to fuel control 100B and into stack 80 upstream of orifice plate 107.

Fuel control 100B is very similar to fuel controls 100 and 100A except that, with fuel control 100B, pressures above a predetermined positive level cause valve 116 to open. Other than that, the 100B fuel control illustrated in FIG. 6 operates substantially like the fuel control illustrated in FIG. 2, and the FIG. 6 embodiment modulates the output pressure at outlet 104 in a manner similar to the modulation which occurs in the FIG. 2 embodiment. As can be seen from the typical data plotted in FIG. 7, as the positive pressure in stack 80 orifice plate 107 (and, accordingly, in control chamber 118B) goes above a predetermined positive pressure the fuel pressure at outlet 104 increases.

Figure 6:
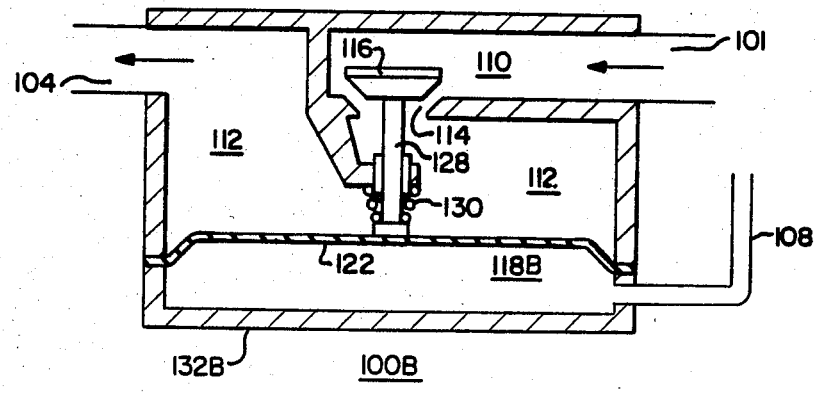
Figure 7:
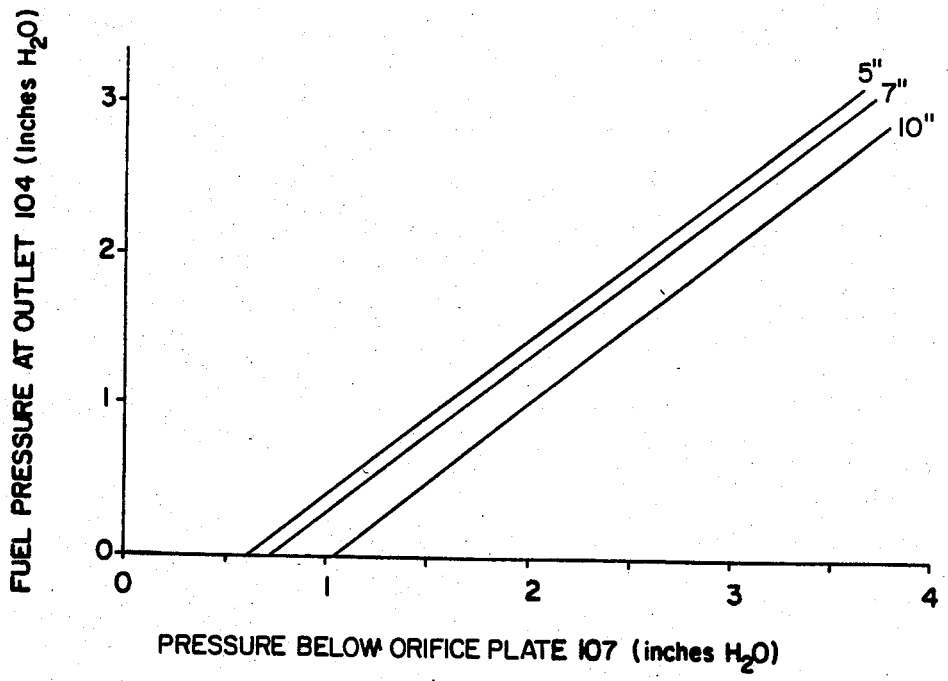

The FIG. 6 embodiment provides this modulation by the combined effect of the outlet gas pressure acting against one side of diaphragm 122 and the effect of the pressure in control chamber 118B acting on the other side of diaphragm 122. As positive pressure in chamber 118B increases, the forces on diaphragm 122 tend to open valve 116 (i.e., to push it upward), resulting in increased pressure in outlet chamber 112 and at outlet 104; the resulting increased outlet pressure in chamber 112 results in a downward force on diaphragm 122, tending to close valve 116 (i.e., to pulse it downward). The equilibrium position of valve 116 and, accordingly, the pressure at outlet 104 is determined by this system balance, which changes as the pressure in chamber 118B changes. Thus, as can be seen from FIG. 7 the gas pressures provided at outlet 104 vary in relation to the pressure below orifice plate 107 and, accordingly, in relation to the pressures within control chamber 118B. As a secondary effect, the input gas pressure at inlet 101 and in inlet chamber 110 affects this equilibrium position as an offset; see for example, the three plots in FIG.

7 which represent typical data for input pressures at inlet 101 of 5, 7 and 10 inches of water respectively.

Fuel controls in accordance with the present invention typically also comprise a bias adjustable from the exterior of the fuel control which, for example, may be used to adjust for manufacturing tolerances. For the embodiments illustrated in FIGS. 2 and 3, such a bias may comprise a spring (not shown) coupled between the center of diaphragm 124 and an adjustment screw (not shown) passing through housing 132. The spring and screw combination serves to adjust the bias or predetermined pressure at which the fuel control will permit gas to flow through valve opening 114. In the case of the embodiment illustrated in FIG. 6, the adjustable bias is typically placed between diaphragm 122 and a screw (not shown) passing through housing 132B, a pressure seal around the screw typically being employed in such a configuration.

We claim:

1. A furnace system comprising:

a fuel gas control for supplying fuel gas to a furnace, the control comprising an inlet chamber having an inlet for receiving a supply of fuel gas and an outlet chamber having an outlet for providing a supply of fuel gas to the furnace, the inlet and outlet chambers being connected by a valve opening; a valve operatively associated with the opening, the valve having a closed position for preventing the flow of fuel gas through the opening and an open position for permitting the flow of fuel gas through the opening; and control chamber means for moving the valve between its open and closed positions in response to pressure variations within the control chamber means;

a combustion air blower for supplying combustion air to the furnace for burning the fuel gas to form combustion gases;

an exhaust stack for exhausting combustion gases from the furnace;

a venturi nozzle in the flow of combustion gases; and means for directly connecting the control chamber means to the venturi nozzle so that the valve is positioned in response to the pressure signal generated in the venturi nozzle by the flow of combustion gases and for moving the valve to its closed position under blocked exhaust stack conditions.

2. The apparatus of claim 1 wherein the control chamber means is formed in part by a diaphragm which is coupled to the valve so that the valve moves in response to movement of the diaphragm.

3. The apparatus of claim 2 wherein the diaphragm forms a wall between the outlet chamber and the control chamber means.

4. The apparatus of claim 3 wherein the valve comprises bias means for biasing the valve to its closed position.

5. The apparatus of claim 4 wherein the control chamber means comprises means for moving the valve so that, when the pressure within the control chamber means is lower than a predetermined negative pressure, gas will flow through the opening to the outlet and so that, when the pressure in the control chamber means is above the predetermined negative pressure, no gas will flow through the opening to the outlet.

6. The apparatus of claim 4 wherein the control chamber means comprises means for moving the valve so that, when the pressure in the control chamber means is lower than a predetermined negative pressure, gas will be provided to the outlet at a pressure related to the pressure in the control chamber means and so that, when the pressure in the control chamber means is above the predetermined negative pressure, no gas will flow through the opening to the outlet.

7. The apparatus of claim 3 wherein the control chamber means comprises means for moving the valve so that, when the pressure within the control chamber means is lower than a predetermined negative pressure, gas will flow through the opening to the outlet and so that, when the pressure in the control chamber means is above the predetermined negative pressure, no gas will flow through the opening to the outlet.

8. The apparatus of claim 3 wherein the control chamber means comprises means for moving the valve so that, when the pressure in the control chamber means is lower than a predetermined negative pressure, gas will be provided to the outlet at a pressure related to the pressure in the control chamber means and so that, when the pressure in the control chamber means is above the predetermined negative pressure, no gas will flow through the opening to the outlet.

9. The apparatus of claim 2 wherein the control chamber means comprises means for moving the valve so that, when the pressure within the control chamber means is lower than a predetermined negative pressure, gas will flow through the opening to the outlet and so that, when the pressure in the control chamber means is above the predetermined negative pressure, no gas will flow through the opening to the outlet.

10. The apparatus of claim 2 wherein the control chamber means comprises means for moving the valve so that, when the pressure in the control chamber means is lower than a predetermined negative pressure, gas will be provided to the outlet at a pressure related to the pressure in the control chamber means and so that, when the pressure in the control chamber means is above the predetermined negative pressure, no gas will flow through the opening to the outlet.

11. The apparatus of claim 1 wherein the control chamber means comprises means for moving the valve so that, when the pressure within the control chamber means is lower than a predetermined negative pressure, gas will flow through the opening to the outlet and so that, when the pressure in the control chamber means is above the predetermined negative pressure, no gas will flow through the opening to the outlet.

12. The apparatus of claim 1 wherein the control chamber means comprises means for moving the valve so that, when the pressure in the control chamber means is lower than a predetermined negative pressure, gas will be provided to the outlet at a pressure related to the pressure in the control chamber means and so that, when the pressure in the control chamber means is above the predetermined negative pressure, no gas will flow through the opening to the outlet.

13. The apparatus of claim 1 wherein a pressure conduit is connected between the control chamber means and an aperture in the venturi nozzle.

14. The apparatus of claim 13 wherein the control chamber means if formed in part by a diaphragm which is coupled to the valve so that the valve moves in response to movement of the diaphragm.

15. The apparatus of claim 14 wherein the diaphragm forms a wall between the outlet chamber and the control chamber means.

16. The apparatus of claim 15 wherein the control chamber means comprises means for moving the valve so that, when the pressure within the control chamber means is lower than a predetermined negative pressure, gas will flow through the opening to the outlet and so that, when the pressure in the control chamber means is above the predetermined negative pressure, no gas will flow through the opening to the outlet.

17. The apparatus of claim 15 wherein the control chamber means comprises means for moving the valve so that, when the pressure in the control chamber means is lower than a predetermined negative pressure, gas will be provided to the outlet at a pressure related to the pressure in the control chamber means and so that, when the pressure in the control chamber means is above the predetermined negative pressure, no gas will flow through the opening to the outlet.

18. The apparatus of claim 14 wherein the control chamber means comprises means for moving the valve so that, when the pressure within the control chamber means is lower than a predetermined negative pressure, gas will flow through the opening to the outlet and so that, when the pressure in the control chamber means is above the predetermined negative pressure, no gas will flow through the opening to the outlet.

19. The apparatus of claim 14 wherein the control chamber means comprises means for moving the valve so that, when the pressure in the control chamber means is lower than a predetermined negative pressure, gas will be provided to the outlet at a pressure related to the pressure in the control chamber means and so that, when the pressure in the control chamber means is above the predetermined negative pressure, no gas will flow through the opening to the outlet.

20. The apparatus of claim 13 wherein the control chamber means comprises means for moving the valve so that, when the pressure within the control chamber means is lower than a predetermined negative pressure, gas will flow through the opening to the outlet and so that, when the pressure in the control chamber means is above the predetermined negative pressure, no gas will flow through the opening to the outlet.

21. The apparatus of claim 13 wherein the control chamber means comprises means for moving the valve so that, when the pressure in the control chamber means is lower than a predetermined negative pressure, gas will be provided to the outlet at a pressure related to the pressure in the control chamber means and so that, when the pressure in the control chamber means is above the predetermined negative pressure, no gas will flow through the opening to the outlet.

* * * * *